US005348288A

United States Patent [19]

Coombs et al.

[11] Patent Number: 5,348,288

[45] Date of Patent: Sep. 20, 1994

[54] MOVING TRAY SORTER WITH VARIABLE TRAY SHIFTING MOTOR CONTROLLER

[75] Inventors: Peter M. Coombs, Tustin; Bryson Bennett, Westminster, both of Calif.

[73] Assignee: Gradco (Japan) Ltd., Tokyo, Japan

[21] Appl. No.: 126,852

[22] Filed: Sep. 27, 1993

[51] Int. Cl.[5] ..... B65H 39/10

[52] U.S. Cl. ..... 271/288; 271/293; 271/294; 270/58

[58] Field of Search ..... 271/288, 292, 293, 294; 270/58

[56] References Cited

U.S. PATENT DOCUMENTS 5,035,412 7/1991 Hiroi et al. ..... 271/294
5,096,184 3/1992 Maekawa et al. ..... 271/294
5,205,549 4/1993 Sato et al. ..... 271/294
5,255,902 10/1993 Coombs ..... 270/53
5,255,908 10/1993 Hiroi et al. ..... 271/294

*Primary Examiner*—H. Grant Skaggs
*Attorney, Agent, or Firm*—Newton H. Lee, Jr.

[57] ABSTRACT

A moving bin sorter has trays which are sequentially shifted upwardly and downwardly relative to a sheet inlet location by a rotary cam driven by an electric motor which drives the cams in opposite directions. The minimum force applied by the motor and lowest motor speed depends upon the load represented by the trays, the weight of the sheets of paper in the trays and the load balancing effect of a spring employed to assist in the lifting of the trays upwardly to engage the cam. The motor power is adjusted and controlled to reduce the applied motor force and speed dependent upon the load which must be overcome in either the upward or downward movement of the trays, for noise and wear reduction.

6 Claims, 4 Drawing Sheets

COPIER MPU
23
QUANTITY OF TOTAL SETS
QUANTITY OF SHEETS/SET
SIZE OF SHEETS
SORTER MPU COUNTS SETS
22
SORTER PROGRAMMABLE DC POWER SUPPLY
20
POWER ADJUST COMMAND
TRAY MOTOR DRIVER
21
TRAY MOTOR
DM
SORTER SHEET COUNTER
24
SHEETS PER SET COUNTED

MOVING TRAY SORTER WITH VARIABLE TRAY SHIFTING MOTOR CONTROLLER

BACKGROUND OF THE INVENTION

Various moving bin sorters have been developed wherein an array of horizontally extended trays are adapted to be sequentially opened at their inlet ends to enhance freedom of sheet entry into the bin space between trays.

Opening of the trays to provide such space may be as a result of movement of the trays by spiral cams, as in U.S. Pat. No. 4,343,463 and 4,911,424 or so-called geneva cams may move the trays as in U.S. Pat. No. 4,328,963, wherein the trays are moved upwardly or downwardly past the sheet inlet location. On the other hand, the trays may be separated at their sheet inlet ends by a cam which moves vertically from tray to tray and also moves the sheet infeed to the opened tray location as in U.S. Pat. No. 4,478,406.

The prior patents referred to above are merely representative of a substantial number of moving bin sorters in which a reversible electric motor drives the cams in opposite directions to sequentially open the trays to enhance sheet entry, and in the operation of which the motor force required to move the cams and thus to open the trays varies. The force required increases in proportion to the number of trays which must be displaced by the cams, the weight of the paper in the trays which are moved, the direction of movement and the extent to which the tray and paper weight may be counterbalanced by a spring, as shown in U.S. Pat. No. 4,328,963 or a comparable counterbalancing spring in other moving bin sorters, such as the sorter illustrated in U.S. patent application Ser. No. 016,450 filed Feb. 11, 1993, co-owned herewith and in U.S. Pat. No. 4,941,659.

The force applied to the trays to move them, therefore, is generally the maximum force necessary to move the maximum load composed of the maximum number of trays with the maximum number of sheets of paper of maximum weight, taking into account any counterbalancing force acting in an upward direction which must be overcome by motor force to move the trays downwardly below the cams when such trays are not loaded with paper sheets.

In practice, the use of motor force and speeds in excess of what is necessary or required to move the trays has historically caused the sorting machines to produce excessive noise and function when the workload is light. This is because the level of noise generated by the electric motor, the gearing which drives the tray shifting mechanisms, and the tray themselves, as well as friction loading and heat vary with load and speed.

Because office machine noise in an office environment can be objectionable and, in some cases, perhaps exceed the level permitted by regulation, efforts have been made to reduce the total noise level of sorting machines. For example, in U.S. Pat. No.5,193,801 the noise caused by the speed at which trays are moved in moving bin sorters can be reduced by varying the speed of the cam drive motor so that at the time of contact trays with one another the trays are moving at a low rate of speed, but during the major portion of the shifting movement of the trays they are moved at a high rate of speed regardless of the load. Also in U.S. patent application Ser. No. 016,450 referred to above and owned in common herewith, the power applied to a stapler in the sorter is varied depending upon the number of sheets to be stapled to reduce noise otherwise caused by applying the same force for stapling relatively few sheets as is required to staple the maximum number of sheets.

SUMMARY OF THE INVENTION

The present invention relates to the provision of a motor controller in a moving bin sorter to variably control the force applied to the bins to move them depending upon the variable load on the motor as a function of the aggregate tray weight, plus the weight of paper in the trays, plus or minus any counterbalancing force, depending upon the direction in which the trays are being moved.

An object of the invention is to reduce noise in the operation of moving bin sorters by reducing the motor force or power applied to the tray shifting mechanism to a low value when low force is required and increasing the force or power applied to the tray shifting mechanism, as required by the task being performed.

The present invention takes into account the fact that the weight of the trays and paper is constantly varying. In a 10 bin sorter adapted to receive 25 sheets per bin, therefore, the paper weight alone varies by a factor of 250 depending upon the number of sheets per bin and the number of sets of sheets in the bins. In addition the paper weight may vary due to different sizes ranging up to, say, 11"×17" from 5"×8".

Another noise, and therefore, a wear factor is caused by increased friction in the tray supporting and moving structure due to the weight of the paper and the trays during movement of the trays. Since reduction of applied voltage to the motor also reduces speed, friction noise and wear are reduced.

These and other features and advantages of the invention will be hereinafter described in detail or will become apparent to those skilled in the art from the description with reference to the accompanying drawings.

DESCRIPTION OF THE PREFERRED EMBODIMENTS

Figure 1:
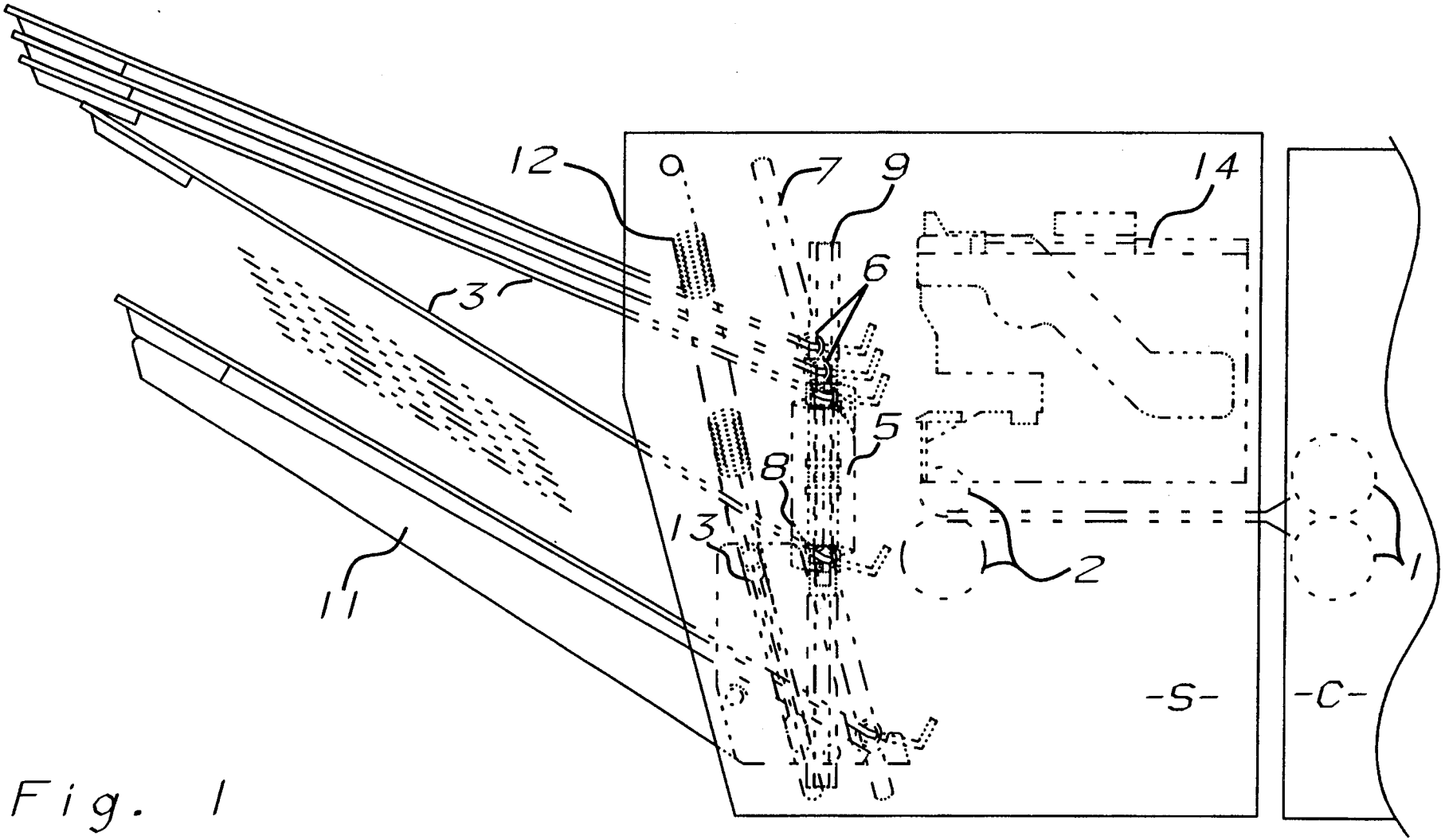
FIG. 1 is a side elevation showing a sorter of the type to which the invention is applicable.

Referring first to FIG. 1, there is shown a sorter S of the moving bin type more specifically shown in the referenced application Ser. No. 016,450 and in my application Ser. No. 848,489, filed Mar. 9, 1992,now U.S. Pat. No. 5,255,902, co-owned herewith and to which reference may be made, adapted to receive sheets of paper from an office copier or printer C. Sheets fed from the copier or printer by output feed roll means 1 are supplied to the sorter and carried by infeed rolls 2 to sorter trays 3 arranged in a stack and adapted to be successively moved vertically at the inner tray ends by rotary cams 5 between closely spaced positions above and below the sheet entry location and widely spaced positions at the sheet entry location, the sheet entry space being determined by the effective height of the cam.

In practice, a pair of cams 5 are located at opposite sides of the sorter assembly. The trays have cam followers or trunnions 6 guided in vertical slots 7 in the sorter frame structure for movement between positions above and below the cams as the trunnions engage in a helical cam slot or track 8 responsive to rotation of the cam shaft 9 in opposite directions. The height of the cam 5 determines the clearance or relatively wide sheet inlet space between the inner tray ends into which the paper sheets are fed by the feed rollers 2. When the trays are above or below the cams, they are relatively closely spaced, to provide a compact assembly.

Drive means (see FIG. 2) are provided to drive the cam shafts in unison, through one revolution to effect intermittent movement of the trays in the desired direction under the control of the cam drive and sheet detector systems usually employed in such sorters. The drive means include a reversible electric drive motor DM having a bevel gear 30 on its output shaft engaged with a bevel gear 31 on one of the cam shafts 9 at one side of the sorter assembly. Typically, a belt or chain drive, driven by the shaft 9 in FIG. 2, drives the other cam shaft in unison, as is well known from the prior art.

In the form shown, the sorter has a bottom lift tray or support 11 which may or may not function to receive sheets. The lift tray moves vertically relative to the sorter frame structure and extends outwardly beneath and supports the outer end of the lowermost tray, with the outer ends of the trays above supported one on the other for pivotal and longitudinal sliding movement, as the inner ends of the trays move vertically to their respective positions above or below the sheet infeed.

At its inner end, the lower tray support is also mounted for vertical movement in the frame structure. In some constructions such upward movement is under the influence of the cam, as seen in prior U.S. Pat. No. 4,911,424 and 5,090,688. In other constructions the lower tray support is lifted by the upward influence of a lift spring 12 as shown in the present embodiment and in U.S. Pat. No. 4,941,659 and application Ser. No. 016,450. In the form shown, the bottom tray support is moved upwardly by the spring 12 in vertically extended guide slots 13 and thereby the spring 12 urges the trays between the bottom support 11 and the lower end of the cams 5 upwardly for engagement with the cams, and the cams do not physically move the bottom support.

Figure 2:
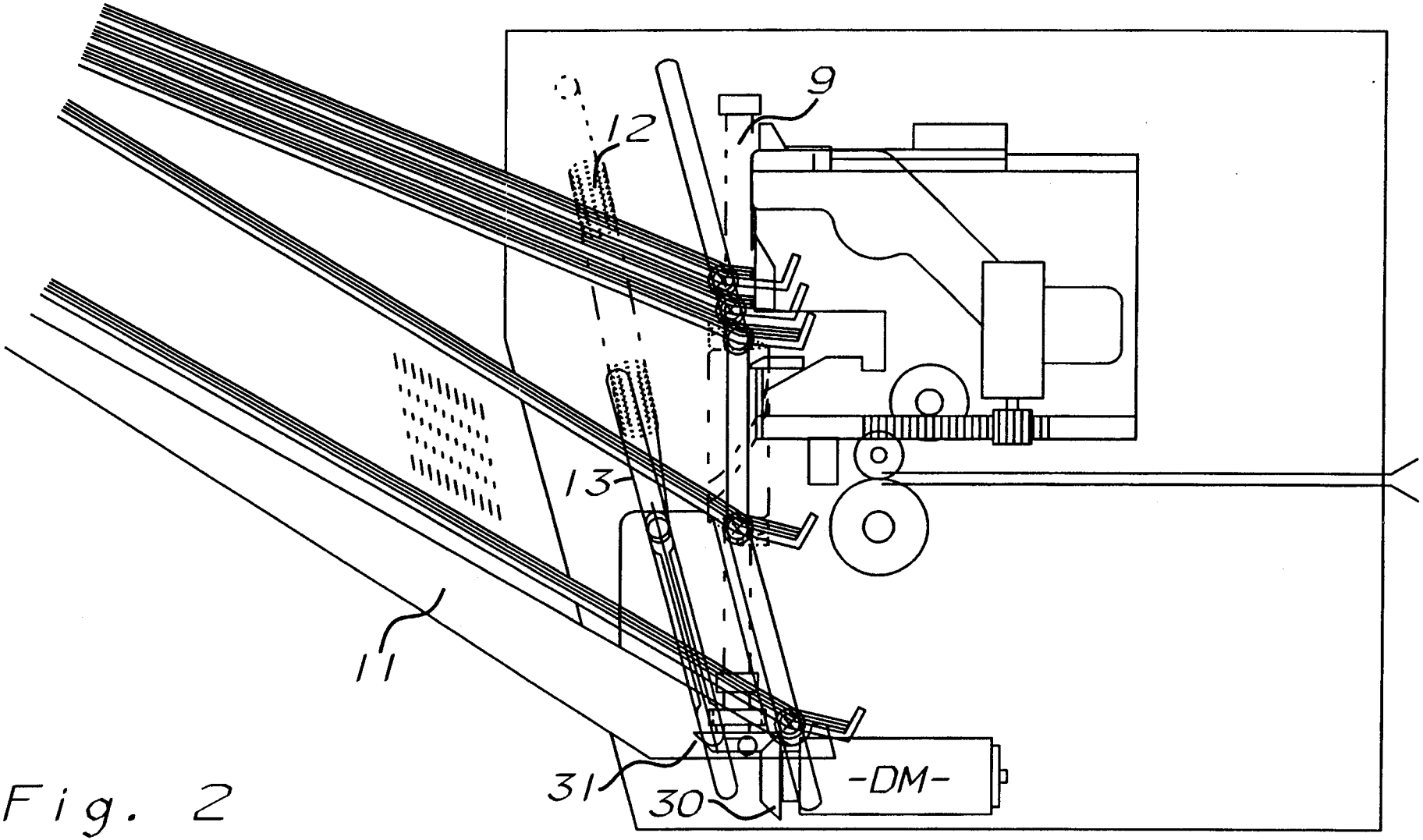
FIG. 2 is an enlarged vertical section through the sorter of FIG. 1 with the stapler in a stapling position.

The specific details of the sorter assembly are well known and adequately described in the above-mentioned patents and application. The illustrated sorter, however, is more particularly like that more specifically shown and described in the aforesaid application Ser. No. 016,450. Thus, the illustrative sorter also has a stapler 14 adapted to be automatically operated to apply staples to sets of sheets in the sorter trays, as shown in FIG. 2 or to be retracted to a non-stapling position, as shown in FIG. 1.

Figure 4:
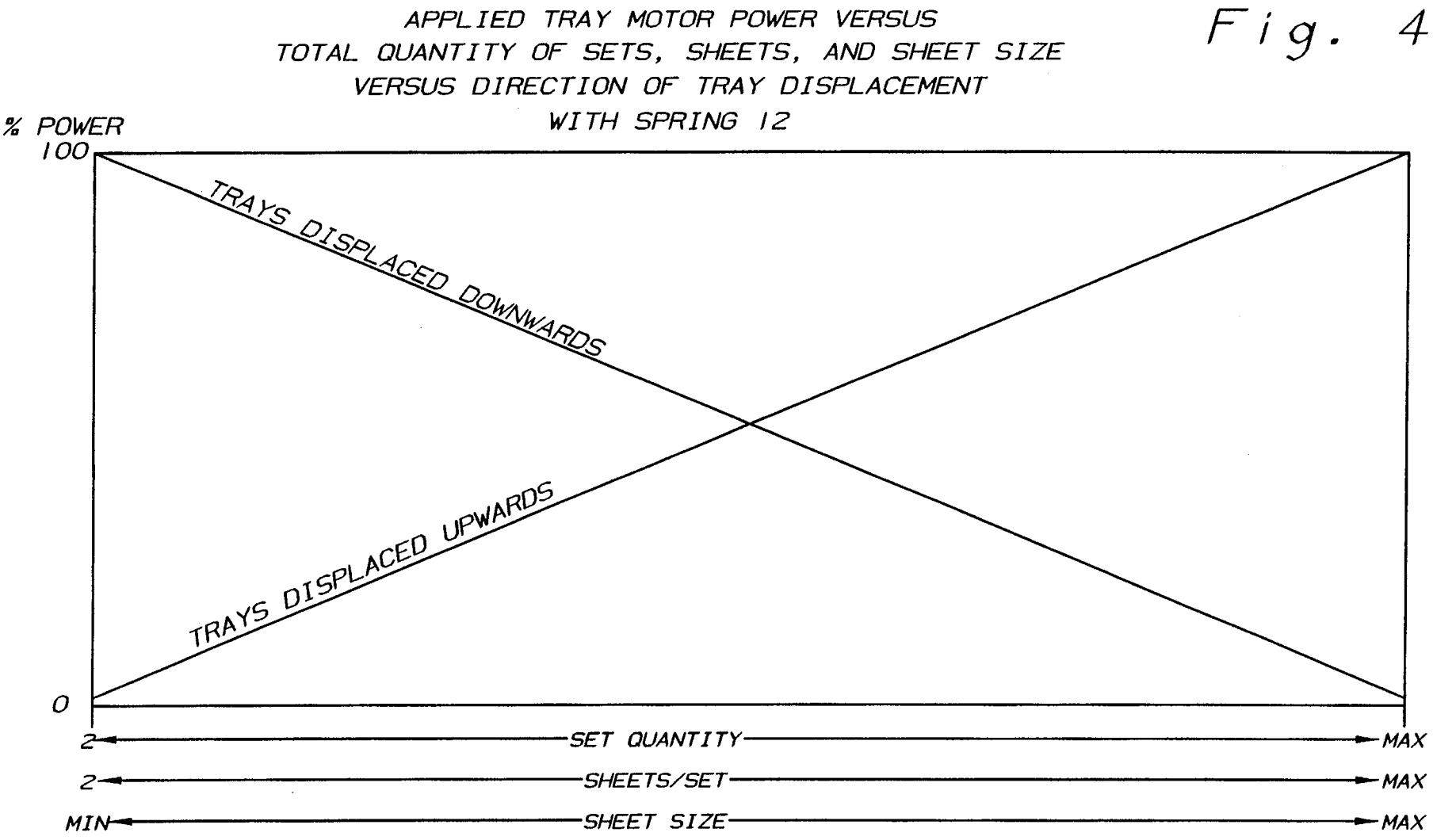
FIG. 4 is a chart illustrating the relative power requirement, as compared with cumulative weight to be moved during the shifting of trays.

It will be recognized from the foregoing that a number of variable loads are applied to the motor DM and the gearing and drive for the cam shafts in sorters of the type here involved, and an inversion in the power requirement takes place in the case of a counterbalancing spring, such as spring 12, because the spring is needed most as a counterbalance during operation at high load on the system and therefore must be overcome during low load operation of the system. This is illustrated in FIG. 4, wherein it will be seen that as the variable weight factors of "set quantity" "sheets/set" and "sheet size" move from low to high, the power required for upwardly moving the bins increases, and, conversely, as those weight factors are reduced, the power required for downwardly moving the bins increases.

In other sorters in which no counterbalancing spring is employed, such as the sorter as in the aforementioned U.S. Pat. No. 4,911,424 adjustments of the motor power is also beneficial, since the power required for moving the bins and the bin lifter upwardly increases as the "set quantity", "sheet per set" and the "sheet size" increase, but there is no inversion of the power required because there is no counterbalancing spring to offset the collective weight as the trays below the cams are being moved upwardly.

The adjustment of motor power also has an advantage when employed in sorters of the type wherein the cams constitute moving bin openers as in the case of sorters like that shown in U.S. Pat. No. 4,478,406. In this case the motor power required for opening the trays, as the cams move from tray to tray as the number of trays above the cam and number of sets increases, the "sheets per set" and the "sheet size" increase.

Figure 3:
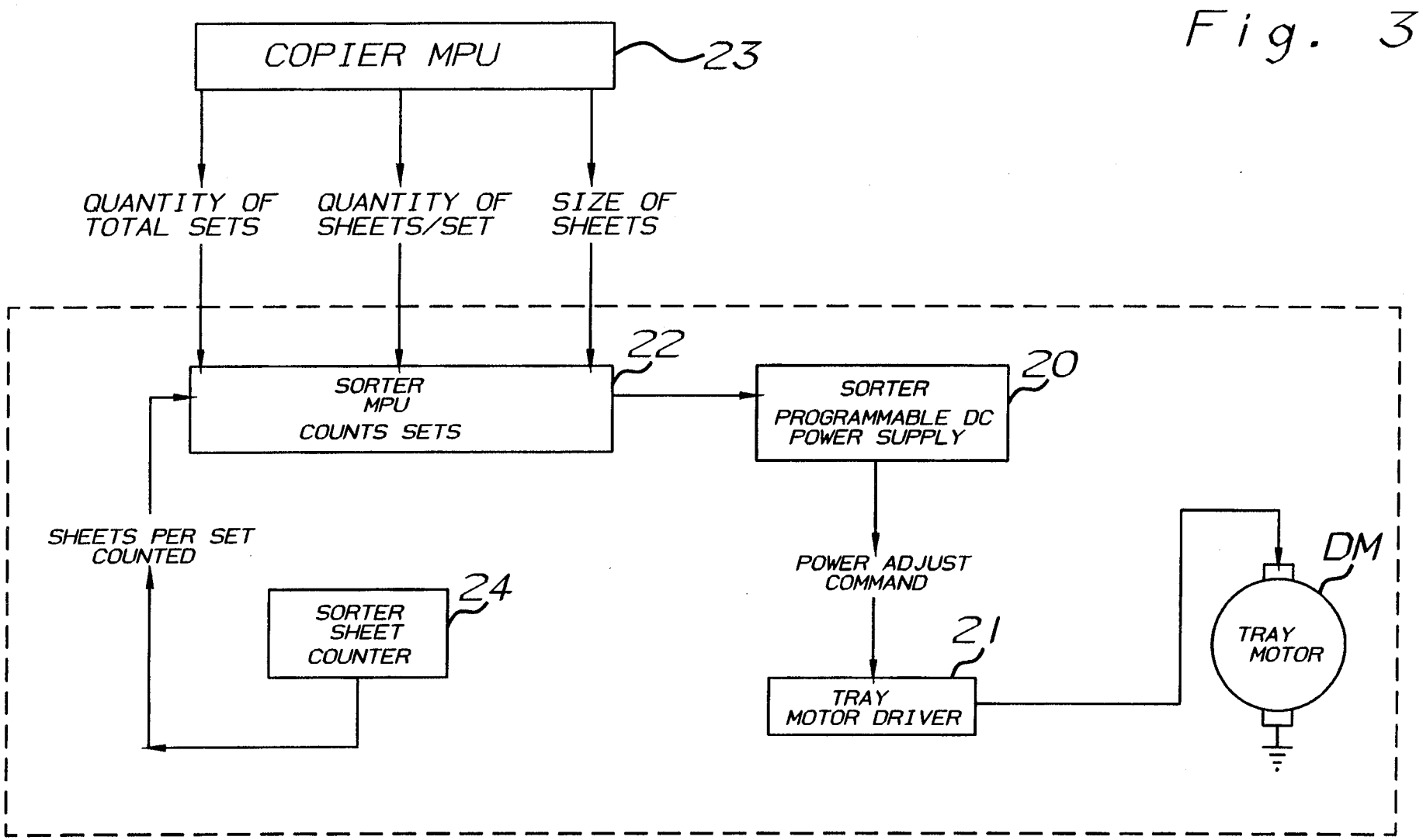
FIG. 3 is a block diagram of the tray shifting motor control system of the invention.

Referring to FIG. 3, it will be seen that the control of the tray drive motor DM is effected by a programmable motor power supply 20 so that the power applied to motor DM is regulated by the tray motor driver 21. Power applied to the motors under the control of power supply 20 may be varied by reducing voltage applied or by controlling the duty cycle, as examples. The DC power supply 20 is responsive to the input from a suitable control device such as a sorter microprocessor unit 22 which is employed in conjunction with a copier microprocessor unit 23 associated with the copier. The unit 23 in a standalone sorter may also be incorporated in the sorter and operated to correspond to commands to the copier. The copier microprocessor unit 23 (or in the case of a standalone sorter, a control unit 23), controls the sorter operation with respect to the quantity of sets of sheets to be collated, the quantity of the sheets per set and the size of the sheets selected for the particular job. Typically the sheets entering the trays are counted by a sorter sheet counter 24 which relays to the sorter control unit 22 information as to the sheets which have been deposited in the respective trays to coincide with the quantity of sheets per set selected by the operator. The tray motor is rotated one revolution per sheet in the normal sorting operation with a cam configured as illustrated. Therefore, cycles of operation can also be monitored by detecting the time required to rotate the cam.

Therefore, it can be seen that the composite information from the sorter microprocessor unit 23 or similar control system, when applied to the programmable DC power supply 20 provides the instruction to the motor driver to cause the applied voltage at the motor DM form the driver 21 to equal the power required to move the trays upwardly, or downwardly against a counterforce as the load factors referred to above are varied responsive to movement of the trays in a sequential manner to receive additional sheets of a selected size to provide the selected quantity of sets of a selected number of sheets. Having thus illustrated and described the invention, the subject matter sought to be patented is best defined in the following claims.

We claim:

1. In a sheet sorting or collating apparatus having a number of trays extended horizontally in vertically spaced relation for receiving a number of sets of sheets of a varying number of sheets of variable sizes, tray shifting means for successively vertically moving said trays, whereby the force required to move said trays and sheets therein varies depending upon the number of trays, the number of sets, the number of sheets per set and the size of the sheets, the improvement wherein said tray shifting means includes a DC electric motor, motor control means for varying the power applied to said motor, and means for adjusting said motor control means responsive to the selection of a number of trays into which a corresponding number of sets are to be fed, the number of sheets per such set and the size of such sheets to increase or decrease the voltage to said motor as a function of the combined load thereon.

2. In a sheet sorting or collating apparatus as defined in claim 1, a spring acting upwardly to counterbalance part of the load on said motor to move said trays upwardly.

3. In sheet handling apparatus as defined in claim 1, said trays being mounted for movement towards and away from one another at sheet entry ends thereof, whereby said trays are closely spaced when positioned above and below said positions for receiving sheets and widely spaced for receiving sheets, and including cam means for widely spacing said trays in said positions for receiving sheets.

4. In sheet handling apparatus as defined in claim 1, said trays being mounted for movement towards and away from one another at sheet entry ends thereof, whereby said trays are closely spaced when positioned above and below said positions for receiving sheets and widely spaced for receiving sheets, and including cam means for widely spacing said trays in said positions for receiving sheets and vertically moving said trays successively to said closely spaced positions above and below said positions for receiving sheets.

5. Sheet handling apparatus as defined in claim 4, including a spring urging the trays below said cam means upwardly.

6. Sheet handling apparatus as defined in claim 4, including a lower tray support and a spring urging said lower tray support and the trays between the lower tray support and said cam upwardly towards said cam means.

* * * * *